US008277239B1

(12) United States Patent
Chan et al.

(10) Patent No.: US 8,277,239 B1
(45) Date of Patent: Oct. 2, 2012

(54) USB AC ADAPTER WITH REMOVABLE USB VEHICLE POWER ADAPTER

(75) Inventors: Jackson Chun Chan, Diamond Bar, CA (US); Yasuhiro Yamamoto, Los Angeles, CA (US)

(73) Assignee: Ever Win International Corporation, City of Industry, CA (US)

( * ) Notice: Subject to any disclaimer, the term of this patent is extended or adjusted under 35 U.S.C. 154(b) by 0 days.

(21) Appl. No.: 13/084,223

(22) Filed: Apr. 11, 2011

(51) Int. Cl.
*H01R 29/00* (2006.01)

(52) U.S. Cl. ..... 439/189; 439/669; 439/655

(58) Field of Classification Search ..... 439/189, 439/669, 639, 640, 655; 320/107
See application file for complete search history.

(56) References Cited

U.S. PATENT DOCUMENTS

D622,218 S 8/2010 Tseng
2011/0084660 A1* 4/2011 McSweyn ..... 320/111
* cited by examiner

*Primary Examiner* — Ross Gushi
(74) *Attorney, Agent, or Firm* — Joe Nieh

(57) ABSTRACT

The USB AC adapter with removable USB vehicle power adapter comprises of a housing with a slot that holds a removable vehicle power adapter. The housing has an alternating current plug adapted to be insertable into an alternating current source. The housing further encloses a universal serial bus. Power conversion circuits are enclosed in the housing to convert the 110V alternating current to both 5V and 12V direct currents. The 5V direct current is directed through the universal serial bus in the housing. The 12V direct current is directed to the slot that holds the removable vehicle power adapter. The removable vehicle power adapter is adapted to be removable from the housing and insertable into a vehicle's cigarette lighter socket and converts the 12V from the vehicle's direct current power supply to 5V direct current output through a universal serial bus.

8 Claims, 5 Drawing Sheets

USB AC ADAPTER WITH REMOVABLE USB VEHICLE POWER ADAPTER

BACKGROUND-FIELD OF INVENTION

The present invention relates generally to an alternating current to direct current adapter. More specifically, the present invention relates to an adapter with an alternating current plug and a fixed universal serial bus and a removable universal serial bus that will function as a vehicle power adapter.

BACKGROUND-DESCRIPTION OF RELATED ART

Alternating current to direct current adapters are commonly used to power and recharge various electronic devices. Many electronic devices use direct currents from a universal serial bus to recharge their rechargeable batteries. There are many adapters that will convert common household 110V alternating current to 5V direct current and output the converted power through a universal serial bus port.

Vehicle power adapters are also commonly used in a vehicle to power and recharge various electronic devices such as mobile phones. Most adapters will convert the 12V direct current from a vehicle's battery system to 5V direct current. The vehicle power adapters usually plug into a vehicle's cigarette lighter socket and provide a universal serial bus port for the 5V direct current output.

However, the two types of adapter are generally designed to be used separately. Therefore, a user will need two separate adapters if the user desires to power or recharge electronic devices from alternating current sources at home as well as from the direct current source inside a vehicle. There is no single adapter that is designed as an alternating current adapter with an integrated removable vehicle power adapter that will function both as an integrated adapter unit as well as separately as separate adapters for alternating currents and direct currents from a vehicle.

BRIEF SUMMARY OF THE INVENTION

The universal serial bus alternating current adapter with removable universal serial bus vehicle power adapter is a compact and portable power adapter that can be used as an integrated unit or separately as separate adapters to provide direct current through a universal serial bus.

The USB AC adapter with removable USB vehicle power adapter comprises of a housing with a slot that holds a removable vehicle power adapter. The removable vehicle power adapter is adapted to be removable from the housing and insertable into a vehicle's cigarette lighter socket and converts the 12V from the vehicle's direct current power supply to 5V direct current output through a universal serial bus. The housing has an alternating current plug adapted to be insertable into an alternating current source. The housing further encloses a universal serial bus. Power conversion circuits are enclosed in the housing to convert the 110V alternating current to both 5V and 12V direct currents. The 5V direct current is directed through the universal serial bus in the housing. The 12V direct current is directed to the slot that holds the removable vehicle power adapter.

DETAILED DESCRIPTION OF THE PREFERRED EMBODIMENT

The following description and figures are meant to be illustrative only and not limiting. Other embodiments of this invention will be apparent to those of ordinary skill in the art in view of this description.

The universal serial bus (USB) alternating current (AC) adapter with removable universal serial bus (USB) vehicle power adapter is a compact and portable power adapter that can be used as an integrated unit with two universal serial buses or separately as separate adapters to provide direct current through a universal serial bus in each separate adapter.

Figure 1:
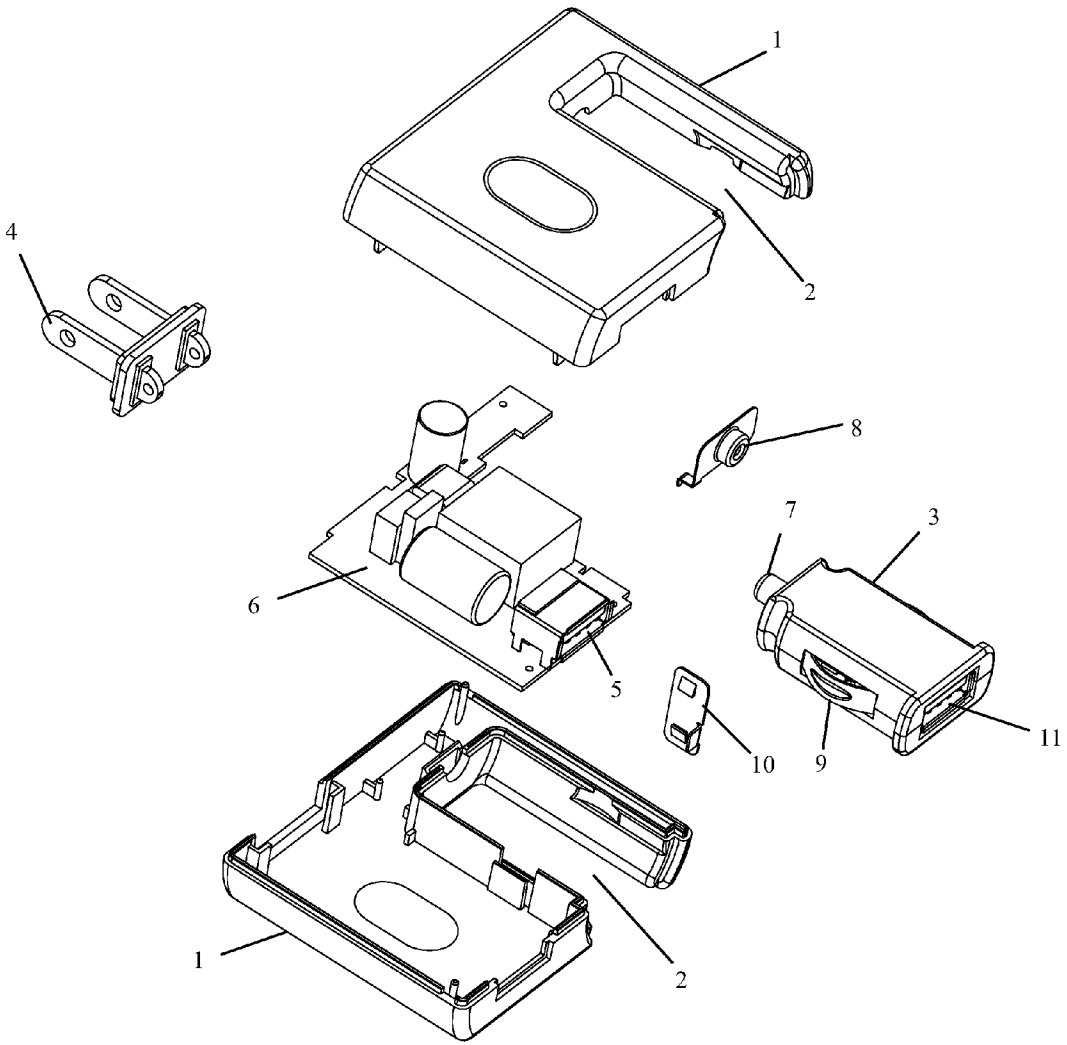
FIG. 1 shows an exploded perspective view of the USB AC adapter with removable USB vehicle power adapter.
Figure 3:
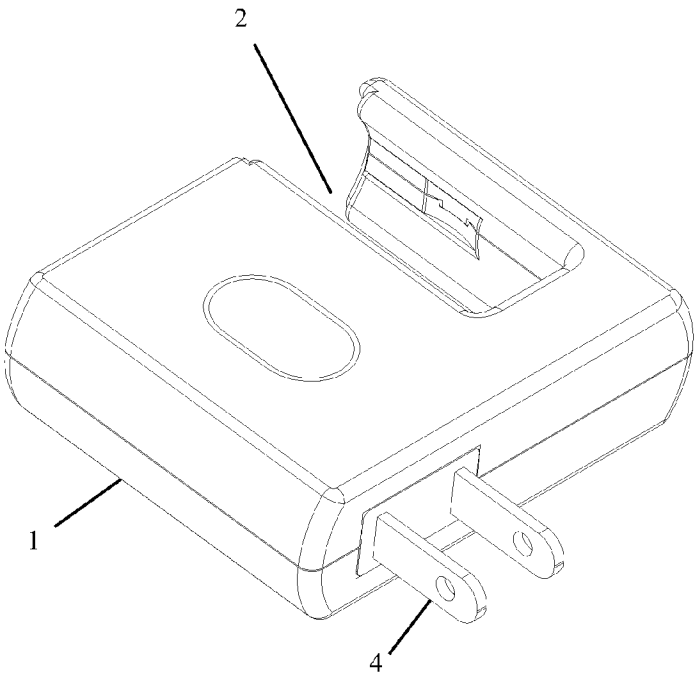
FIG. 3 shows a perspective rear view of the housing of the USB AC adapter with removable USB vehicle power adapter.
Figure 2:
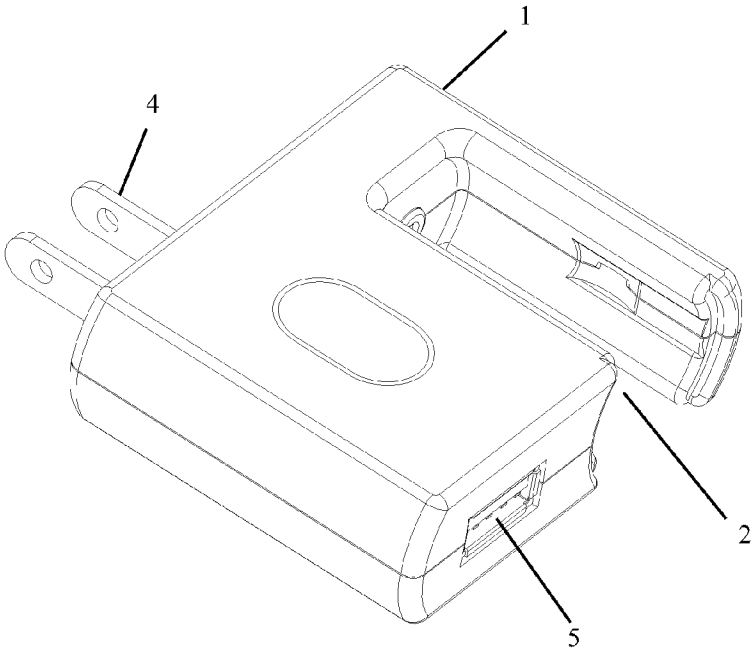
FIG. 2 shows a perspective front view of the housing of the USB AC adapter with removable USB vehicle power adapter.
Figure 9:
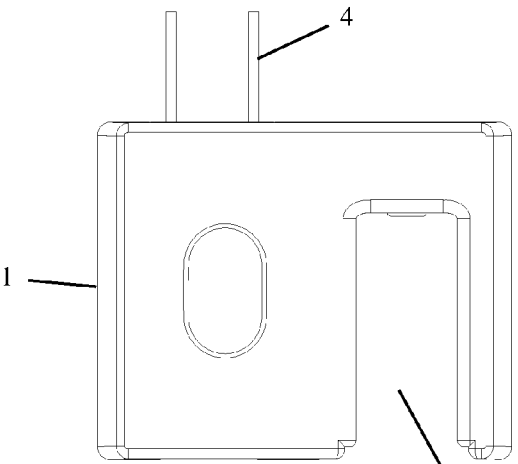
FIG. 9 shows a bottom elevation view of the housing of the USB AC adapter with removable USB vehicle power adapter.
Figure 8:
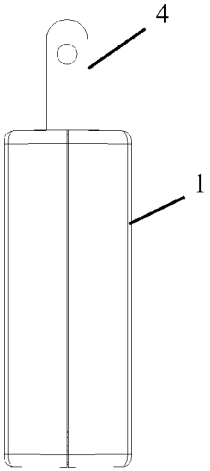
FIG. 8 shows a right side elevation view of the housing of the USB AC adapter with removable USB vehicle power adapter.
Figure 5:
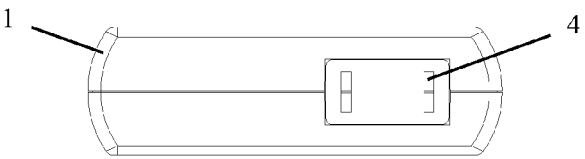
FIG. 5 shows a rear elevation view of the housing of the USB AC adapter with removable USB vehicle power adapter.
Figure 6:
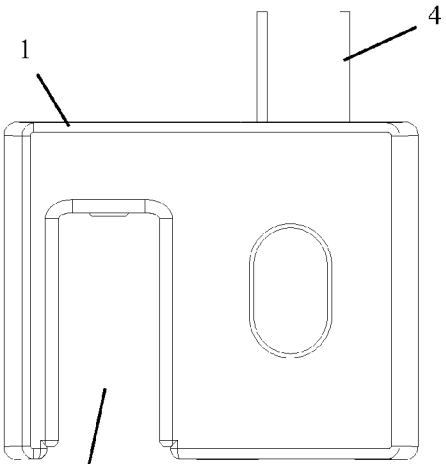
FIG. 6 shows a top elevation view of the housing of the USB AC adapter with removable USB vehicle power adapter.
Figure 7:
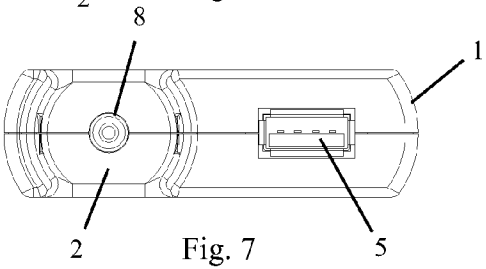
FIG. 7 shows a front elevation view of the housing of the USB AC adapter with removable USB vehicle power adapter.
Figure 4:
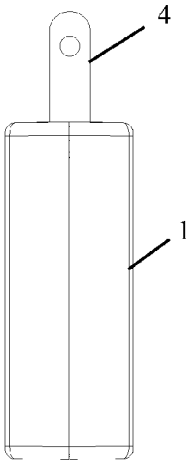
FIG. 4 shows a left side elevation view of the housing of the USB AC adapter with removable USB vehicle power adapter.
Figure 11:
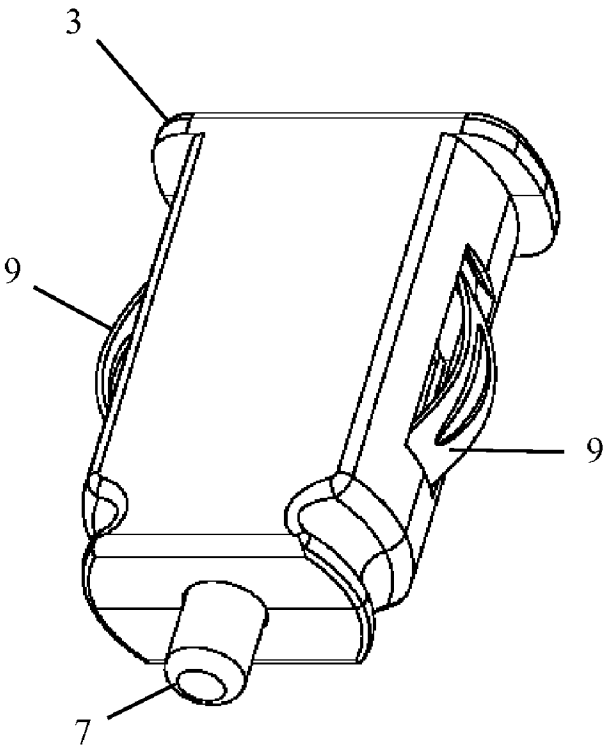
FIG. 11 shows a perspective rear view of the removable USB vehicle power adapter of the USB AC adapter with removable USB vehicle power adapter.

FIG. 1 shows the preferred embodiment of the USB AC adapter with removable USB vehicle power adapter which comprises of a flat rectangular plastic housing 1 with a slot 2 that holds a flat removable vehicle power adapter 3. As can be seen in FIGS. 1, 2, 3, 6, 7, and 9, the slot 2 has two sides that are open to enable easy access to the inserted vehicle power adapter 3. The open sides in the slot 2 allow the inserted vehicle power adapter 3 to be easily grabbed with the fingers from the open sides and removed from the housing 1. The open-side design enables the removable vehicle power adapter 3 to fit flush with the housing 1 yet can still be easily removed from the housing 1. Furthermore, the open-side design facilitates a compact and flat housing design. The flat rectangular plastic housing 1 is thinner than a standard vehicle power adapter.

As shown in FIGS. 1, 2, 3, 4, 5, 6, 8, and 9, the housing 1 has an alternating current plug 4 adapted to be insertable into an alternating current source, such as the common household wall socket. The alternating current plug 4 may be fixed or it may be one of various folding, pivoting, or retracting plug designs well known in the art. The housing 1 further encloses a universal serial bus 5, shown in FIGS. 1, 2, and 7. A power conversion circuit 6 is enclosed in the housing 1 to convert the 110V alternating current to both 5V and 12V direct currents. In the preferred embodiment, there is one combined power conversion circuit 6 for both the 5V and the 12V direct currents. Alternatively, two separate power conversion circuits may be utilized with one conversion circuit for the 5V and a separate one for the 12V. The 5V direct current is directed to the universal serial bus 5 in the housing 1. The 12V direct current is directed to the slot 2 that holds the removable vehicle power adapter 3.

Figure 10:
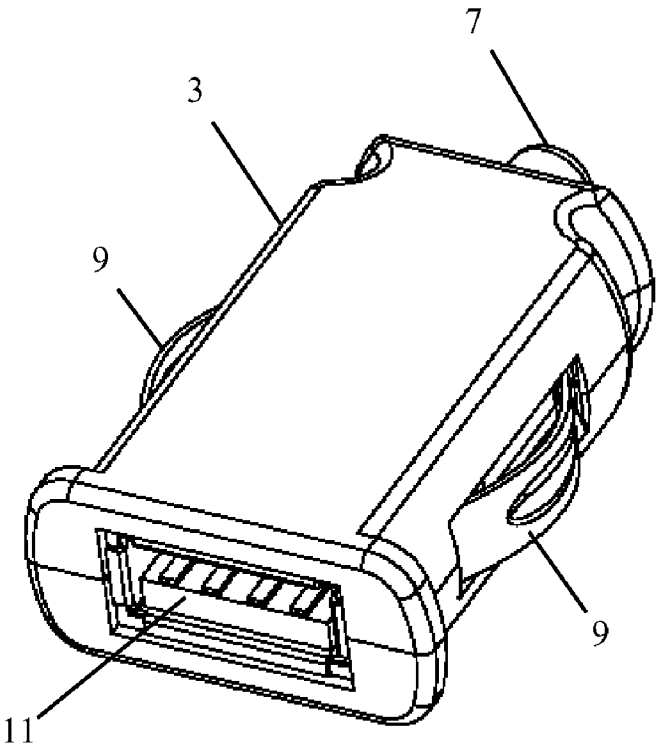
FIG. 10 shows a perspective front view of the removable USB vehicle power adapter of the USB AC adapter with removable USB vehicle power adapter.
Figure 13:
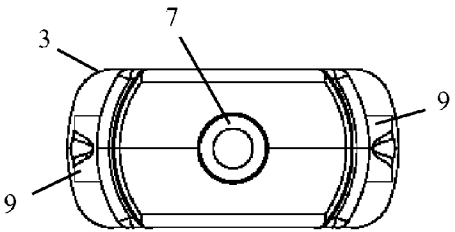
FIG. 13 shows a rear elevation view of the removable USB vehicle power adapter of the USB AC adapter with removable USB vehicle power adapter.
Figure 12:
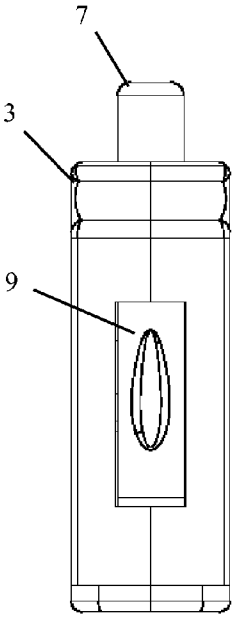
FIG. 12 shows a left side elevation view of the removable USB vehicle power adapter of the USB AC adapter with removable USB vehicle power adapter.
Figure 14:
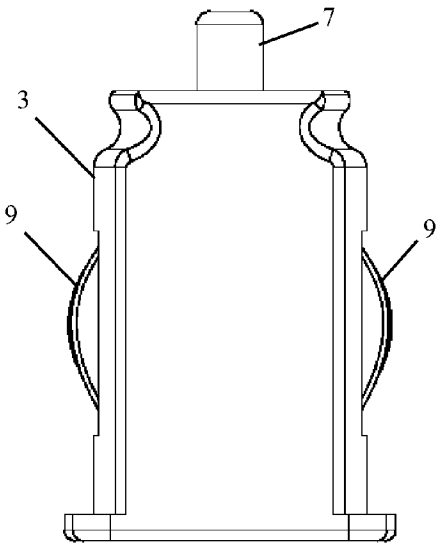
FIG. 14 shows a top elevation view of the removable USB vehicle power adapter of the USB AC adapter with removable USB vehicle power adapter.
Figure 15:
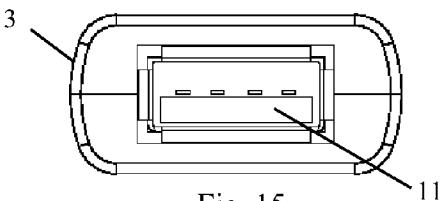
FIG. 15 shows a front elevation view of the removable USB vehicle power adapter of the USB AC adapter with removable USB vehicle power adapter.
Figure 16:
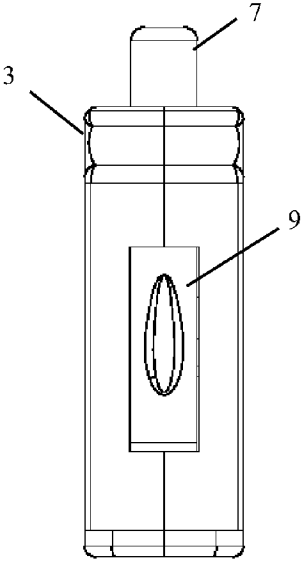
FIG. 16 shows a right side elevation view of the removable USB vehicle power adapter of the USB AC adapter with removable USB vehicle power adapter.
Figure 17:
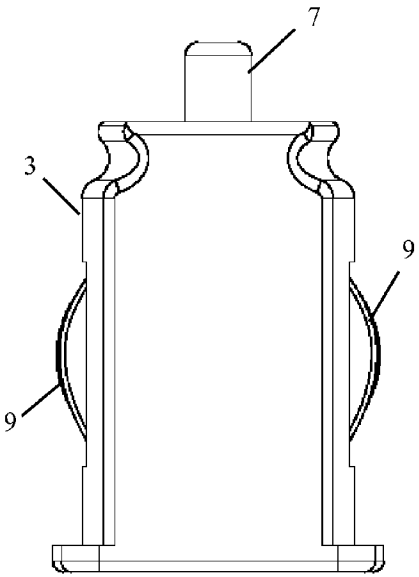
FIG. 17 shows a bottom elevation view of the removable USB vehicle power adapter of the USB AC adapter with removable USB vehicle power adapter.

In the preferred embodiment shown in FIGS. 1 and 10 through 17, the removable vehicle power adapter 3 has a flat, semi-rectangular profile and is substantially the same thickness as the flat housing 1. Thus, the removable vehicle power adapter 3 is thinner and substantially more compact than a standard vehicle power adapter, which has a circular profile. The length and width of the removable vehicle power adapter 3 are approximately the length and width of the slot 2 in the housing 1. Therefore, when the removable vehicle power adapter 3 is fully inserted into the slot 2, it will fit flush with the sides of the housing 1 with virtually no protruding parts. A spring biased electrical contact 7 is provided at one end of the removable vehicle power adapter 3 to contact the 12V electrical contact 8 in the slot 2 in the housing 1. Additional protruding electrical contacts 9 are provided on one or both of the narrow sides of the removable vehicle power adapter 3 to contact the corresponding electrical contacts 10 in the sides of the slot 2 in the housing 1. The same electrical contacts 7, 9 on the removable vehicle power adapter 3 will contact corresponding electrical contacts in the cigarette lighter socket in a vehicle when it is inserted into the cigarette lighter socket. As shown in FIGS. 1, 10, and 15, a USB port 11 is provided at the other end of the removable vehicle power adapter 3. A power conversion circuit is provided in the removable vehicle power adapter 3 to convert the 12V direct current to 5V direct current. The removable vehicle power adapter 3 is adapted to be easily removable from the housing 1 by grabbing it through the open sides of the slot 2 and insertable into a vehicle's 12V cigarette lighter socket that are commonly available in modern vehicles to converts the 12V from the vehicle's direct current power supply to 5V direct current and outputs through the USB port 11.

When the removable vehicle power adapter 3 is inserted in the slot 2, the present invention provides an AC adapter with two USB ports 5, 11. When the removable vehicle power adapter 3 is removed from the slot 2, the present invention provides an AC adapter with a USB port 5 and a vehicle power adapter 3 also with a USB port 11. Each of the separated adapter can be used independently of the other. The removable vehicle power adapter 3 can be inserted in the slot 2 in the housing 1 for compact storage and transported as a single unit.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A USB AC adapter with removable USB vehicle power adapter comprising:

a housing with an alternating current plug, a slot defined by said housing, a universal serial bus port enclosed in said housing, and a power conversion circuit enclosed in said housing; and a removable vehicle power adapter with a power conversion circuit and a universal serial bus adapted to be insertable and removable from said slot defined by said housing;

wherein said slot has two open sides to enable access to the removable vehicle power adapter inserted therein.

2. A USB AC adapter with removable USB vehicle power adapter as in claim 1, wherein said removable vehicle power adapter is dimensioned to fit substantially flush with the open sides of the slot.

3. A USB AC adapter with removable USB vehicle power adapter as in claim 1, wherein said removable vehicle power adapter is dimensioned to fit substantially flush with the housing.

4. A USB AC adapter with removable USB vehicle power adapter comprising:

a housing with an alternating current plug, a slot with two open sides defined by said housing, a universal serial bus port enclosed in said housing, and a power conversion circuit enclosed in said housing that converts 110V alternating current to 5V and 12V direct currents; and a removable vehicle power adapter with a universal serial bus adapted to be insertable and removable from said slot and dimensioned to fit substantially flush with said housing.

5. A USB AC adapter with removable USB vehicle power adapter as in claim 4, wherein said alternating current plug is fixed in said housing.

6. A USB AC adapter with removable USB vehicle power adapter as in claim 4, wherein said alternating current plug is foldable.

7. A USB AC adapter with removable USB vehicle power adapter as in claim 4, wherein said alternating current plug is pivotable.

8. A USB AC adapter with removable USB vehicle power adapter as in claim 4, wherein said alternating current plug is retractable.

* * * * *